US006004369A

United States Patent [19]

Bonometti

[11] Patent Number: 6,004,369

[45] Date of Patent: Dec. 21, 1999

[54] STEEL PRODUCTION METHOD

[76] Inventor: Natale Bonometti, Via Prignole 5, Bovezzo (Brescia), Italy

[21] Appl. No.: 09/132,947

[22] Filed: Aug. 11, 1998

[30] Foreign Application Priority Data

Oct. 29, 1997 [IT] Italy ..... BS97A0088

[51] Int. Cl.[6] ..... C21B 13/12; C21B 13/14

[52] U.S. Cl. ..... 75/10.38; 75/581; 266/156; 266/901

[58] Field of Search ..... 75/10.15, 10.22, 75/10.38, 581; 266/236, 900, 901, 156; 373/11

[56] References Cited

U.S. PATENT DOCUMENTS 5,541,952 7/1996 Genge et al. ..... 75/10.38

*Primary Examiner*—Prince Willis
*Assistant Examiner*—Tima McGuthry-Banks
*Attorney, Agent, or Firm*—McGlew and Tuttle, P.C.

[57] ABSTRACT

The invention relates to a method to produce steel from a ferrous material, by using one furnace divided into, at least, two vessels which are connected to each other at least by ducts for the off-gases and ducts for the melted metal. The vessels have a growing capacity starting from the first one; the material to be cast is divided into a first charge for the first vessel and a second charge for, at lesast, a second vessel of the furnace, the charge of the material in the first vessel of the furnace is melted using electric energy and/or combustion energy; the off-gases from the first vessel of the furnace are sent to the second vessel of the furnace in order to heat the charge of material in said second vessel, and the off-gases in the second vessel are sent to the first vessel to heat the material in this first vessel; the metal melted in the first vessel is poured in the second vessel of the furnace in order to contribute with its own thermal energy and with combustion energy to the melting of the material charged in the, at least, second vessel; the metal melted in the second vessel is poured for the use.

7 Claims, 2 Drawing Sheets

STEEL PRODUCTION METHOD

FIELD OF THE INVENTION

The present invention concerns the steel industry and particularly the steel production and equipment for steel production.

BACKGROUND OF THE INVENTION

Nowadays, the Electric Arc Furnaces (EAF) are the most frequently used method for the steel production. With such method there are however problems related to energy consumption, thermal losses, electrode consumption, maintenance costs, quality of the steel obtained in this way and, last but not least, the environmental situation for the workers.

Till now the steel plants management has tried to increase the EAF capacity in order to increase the quantity of the produced steel and consequently to reduce the unit cost, dividing the total cost on a larger quantity of produced material.

The electric steel industry demand is a technology to improve the product quality and to reach higher productivity, also considering:

- lower costs and consumption for the electric energy;
- lower electrode consumption;
- lower maintenance requirements, i.e. higher availability production time;
- max. flexibility in the utilisation of alternative power sources as gas, carbon, post-combustion energy, etc;
- max. utilisation of the off-gases to pre-heat the scrap to be melted;
- environmental situation improvement for the steel-making facility in respect to noise, off-gases volume, amount of dust, etc;
- reduction of the flicker in connection with higher productivity;
- possibility to retrofit in the existing steel plants.

One part of these requirements are already fulfilled by the several developments in the last years, but always with certain compromises without complete answers to all demands.

SUMMARY AND OBJECTS OF THE INVENTION

The present invention was developed to find an optimum compromise to fulfil all the above stated requirements by a new original steel production methodology.

The present invention proposes a steel production method based on a plant which includes one furnace divided into at least two parts, or vessels, interconnected by a duct system for the off-gases and with possibility to tap molten steel from a vessel to another one, and wherein:

- the capacity of the different vessels increases starting from the first one, and
- the row material (scrap) to be cast is divided into a charge for the first vessel and a second charge for the at least second vessel of the furnace;
- the charge of the first vessel of the furnace is melted using electric energy and alternative combustion energy;
- the off-gases from the first vessel can be conveyed to the second vessel of the furnace in order to pre-heat the scrap present in the second vessel, and the off-gases of the second vessel, in different time, can reach the first vessel to pre-heat the present scrap;

- the molten steel of the first vessel is poured in the second (at least) vessel to contribute, with its thermal energy, to cast the scrap present in the second vessel;
- the melted metal of the second vessel of the furnace is discharged for the use.

The vessels of the furnace can be more than two, for example three and, in this case, to facilitate the passage of the off-gases and to pour the liquid metal from one vessel to another (the off-gases tend to move upward and the liquid metal tends to move downward) at least the second vessel can be moved from a lower level to an upper level in comparison with the first one or to the third vessel of the furnace.

The advantages of this invention are essentially the following:

- A furnace which is divided into some parts, or vessels, can be installed also in the existing steel plants, with the possibility to have larger steel production without using larger capacity furnaces.
- The total furnace capacity can be easily fitted to the production requirements according to the subdivision of the furnace in more vessels.
- The total productivity is higher and the tap to tap time is led back to the first vessel tapping time (are not considered the starting and the final cycles).
- The total electric energy consumption is lower, related to the first vessel casting operations. The remaining energy required can be supplied by combustible material as gas, carbon and oxygen, CO post-combustion and also coming from a possible aluminothermic process or similar.
- The electrodes consumption is lower according to the less quantity of electrical energy required in the total balance of energy utilised.
- The vessels of the furnace placed after the first one, because of electric arc lack, do not require water cooled panels, with consequent decrease in energy dispersion.
- The off-gases are utilised in the pre-heating of the material in the various vessels of the furnace.
- The total investment for the equipment is reduced compared to conventional EAF as the operations require a less expensive electrical equipment, the electrodes are not present in the vessels after the first one, simple loading devices, etc.
- The economical engagement for the electrical energy is reduced because of the lower electric power required and the utilisation of smaller transformers.
- The off-gases volume is reduced as they are conveyed and used from one vessel to the others before the final exhausting, and that decreases also the off-gases dusts.
- The flicker is reduced due to the lower electric power, engaged only for the first vessel.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
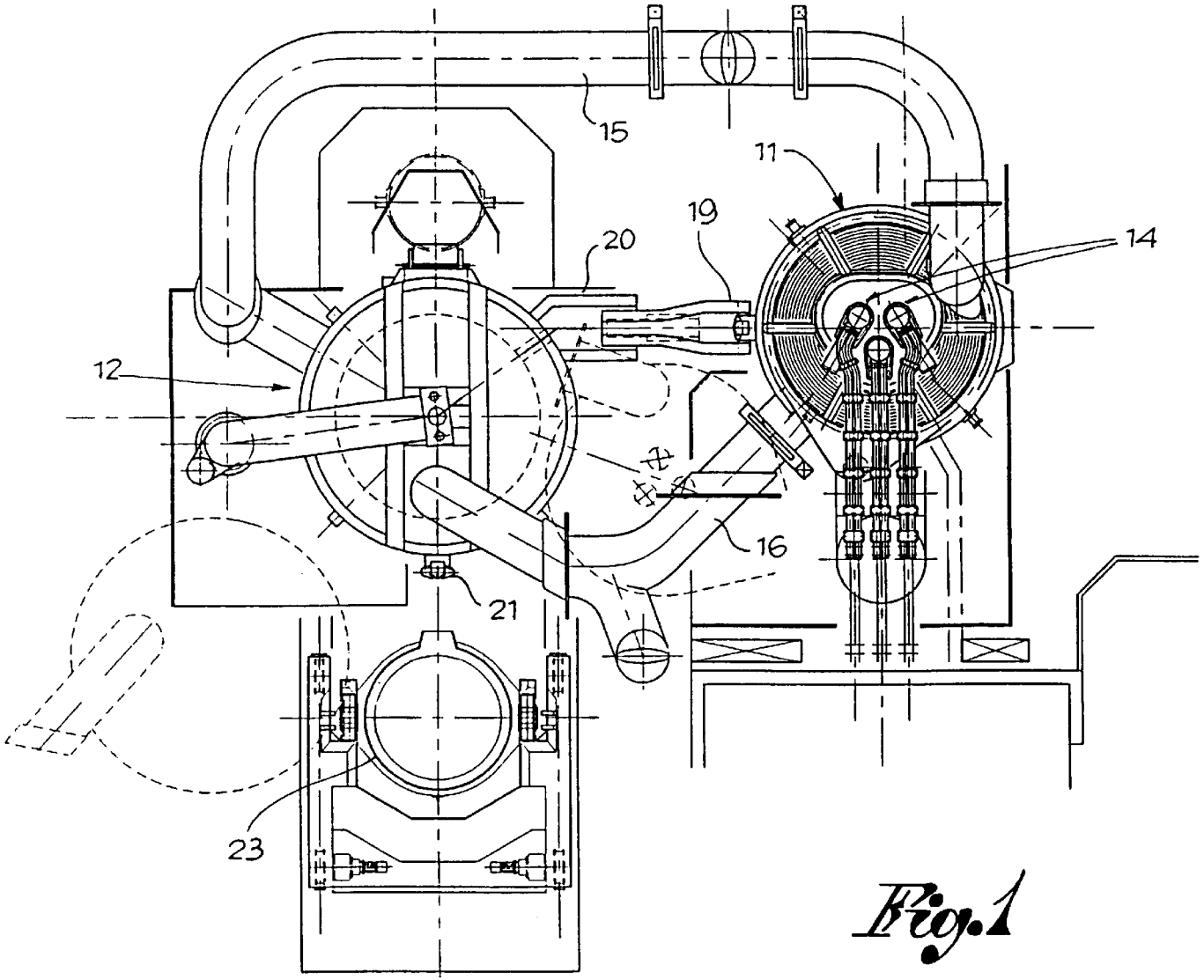
FIG. 1 shows a plan view of an equipment to realise the method of the invention.
Figure 2:
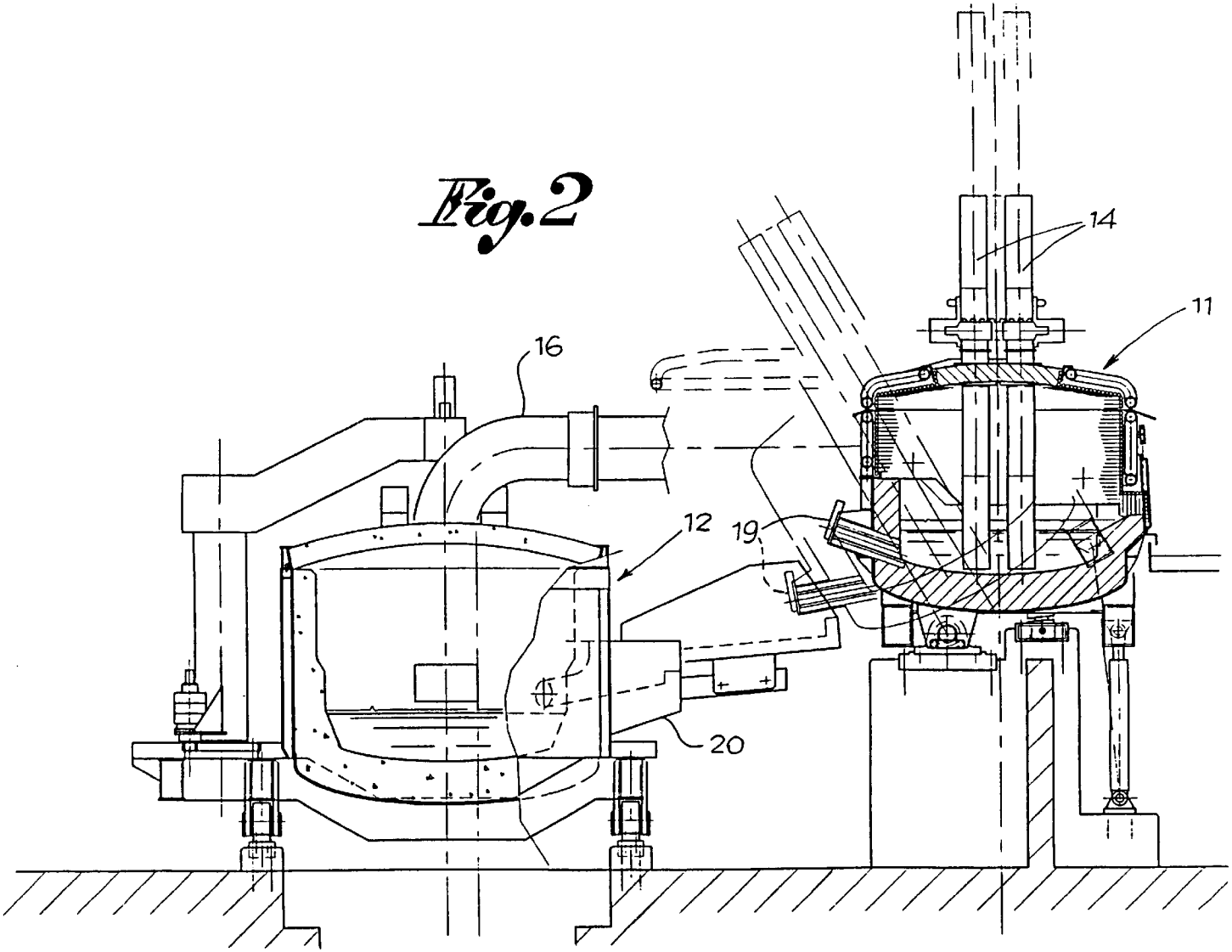
FIG. 2 shows a section of a furnace with two vessels.

The drawings and the description show an example of steel plant with a furnace composed by two vessels. The vessels could be three or more. In case of two vessels, the furnace of the invention include a first vessel (11) and a second vessel (12); the second vessel (12) is in lower position compared to the first vessel (11). The first vessel has a lower capacity than the second one. The sum of the row material charged in the single vessels (11) and (12) allows the final amount of molten steel at every melting cycle, starting from one total charge of solid material to be divided in the two vessels. Therefore, the second vessel can contain the quantity of steel produced in the first vessel added to the steel produced by itself.

For instance, for a production cycle of 80 tons, the first vessel can have a production capacity of 66 tons and the second vessel a production capacity of 22 tons. Therefore, the first vessel capacity will be 60 tons of liquid steel and 80 tons for the second one. Any other combination among the production capacities of different vessels is allowed provided the compatibility with the final result to be obtained.

The charge of the solid material will be properly divided between the different vessels. In particular the size of the material to be charged in the first vessel should be smaller than the material to be charged in the second vessel, because of the different main energy utilised: electrical for the first vessel, fuel burners of liquid, gaseous or solid for the second.

The off-gases produced in the first vessel (11) can be conveyed through a connecting duct (15) in the second vessel (12). The off-gases in the second vessel can be conveyed through a connecting duct (16) back to the first vessel (11). Both, the first and the second vessel have direct connecting ducts to the final exhausting system.

The first vessel (11) has a tapping hole (19) in order to pour, by an hole (20) the liquid steel in the second vessel (12). The second vessel (12) has the same tapping system (21) for the melted metal towards a ladle (23) and an outlet for the slag towards a pot.

To facilitate the melted metal discharge each vessel (11 and 12) can oscillate on a base and can be reclining using an hydraulic actuator or similar.

In this furnace type the solid material charged in the first vessel is cast at the desired temperature, using the electric energy transformed in thermal energy by the voltaic arc of the electrodes 14. At the same time the hot off-gases produced in the first vessel are conveyed for pre-heating the solid material charged in the second vessel.

When the total charge melting in the first vessel is completed, the liquid metal and the slag are poured in the second vessel of the furnace, obtaining with own thermic energy, together with the combustion thermic energy, the melting of the pre-heated charge in the second vessel.

For instance, with a furnace and process according to the invention, the first vessel (11) of the furnace includes three electrodes 14 and the second vessel (12) oxygen/carbon gas burners. The first vessel (11) is a normal EAF with tapping weight of 60 ton of liquid steel, equipped with a 60 MVA transformer and three side burners with a capacity of 2,8 MW each and a door burner of 3,5 MW. In the first vessel (11) high carbon steel, approx. 2,5% C, is produced. The charge is metallic scrap with an average density of 0,7 t/m3. The vessel is equipped by tapping hole with sliding gate.

The second vessel (12) is completely lined with refractory, instead water cooled panels, to avoid the liquid steel cooling.

In a production process tapping 80 ton of liquid steel, the first vessel (11) is charged with 66 ton scrap, the second vessel (12) with 22 ton of scrap. At the process beginning, in the first vessel (11) carbon steel (2,5%) is melted. After approx. 34 min., the liquid metal can be tapped at approx. 1500° from the tapping sliding gate (giving minimum temperature loss), discharging it into the second vessel (12), previously charged with approx. 22 ton. scrap.

The molten steel, with high carbon content, is decarburised in the second vessel (12) creating energy which contributes to the melting of the scrap charged in the second vessel in order to produce steel with carbon content of 0,1% or less, similar to a converter production. The liquid steel produced (80 ton approx.) is tapped, for the use, in a ladle placed on the suitable ladle car.

After the first phase, the scrap newly charged in the first vessel (11) will be pre-heated with the off-gases of the second vessel (12), and in different time the scrap in the second vessel will be pre-heated by the off-gases of the first vessel. And so on for any following cycle.

The cycle is programmed so that when the melting begins in a vessel (for instance n.11) in the other vessel (for instance n.12) the scrap in pre-heating takes place using the hot off-gases coming from the melting material. The operation takes place alternatively.

It has to be remarked that the furnace can have three, or more, vessels placed so that the starting scrap can be charged in each vessel in decreasing quantities from the first to the last and the melted steel is poured from the first to the second and the third vessel, and so on, and the off-gases of each vessel can be used for the pre-heating of the scrap in the other vessels according to the pre-set cycle.

I claim:

1. A method to produce steel, the method comprising the steps of:

providing first and second vessels;

charging said first vessel with a first charge of material to be cast;

charging said second vessel with a second charge of material to be cast;

melting said first charge in said first vessel with one of electric energy and combustion energy, said step of melting said first charge producing off-gases;

heating said second charge in said second vessel with the off-gases from said first vessel;

conveying melted metal from said first vessel to said second vessel;

melting said second charge in said second vessel with combustion energy;

removing melted metal from said second vessel to produce the steel.

2. The method in accordance with claim 1, wherein:

said step of melting said second charge in said second vessel includes providing heat from said melted metal received from said first vessel.

3. The method in accordance with claim 1, further comprising the steps of:

conveying off-gases from said melting of said first charge in said first vessel into said second vessel;

connecting said first and second vessels by a gas duct and a melted metal duct; and providing said second vessel with a larger capacity than said first vessel.

4. The method in accordance with claim 1, further comprising;

charging another charge of material to be cast into said first vessel after said conveying of said melted metal from said first vessel to said second vessel;

heating said another charge in said first vessel with off-gases from said second vessel.

5. The method in accordance with claim 1, further comprising:

providing a third vessel;

conveying melted metal from said second vessel to said third vessel;

said second vessel has a larger capacity than said first vessel;

said third vessel has a larger capacity than said second vessel.

6. The method in accordance with claim 5, further comprising:

moving said second vessel between a raised position and a lowered position with respect to said first and third vessels.

7. The method in accordance with claim 1, wherein:

said melting of said first charge in said first vessel is with electric energy.

* * * * *